United States Patent [19]

Murray et al.

[11] 4,157,186

[45] Jun. 5, 1979

[54] HEAVY DUTY ROTATING BLOWOUT PREVENTOR

[76] Inventors: Edwin G. Murray, 4208 Waverly; Donnie L. Murray, 4207 Lynnbrook, both of Odessa, Tex. 79762

[21] Appl. No.: 842,694

[22] Filed: Oct. 17, 1977

[51] Int. Cl.[2] ..... F16J 15/50

[52] U.S. Cl. ..... 277/31

[58] Field of Search ..... 277/31, 29, 59

[56] References Cited

U.S. PATENT DOCUMENTS

| | | | |
|---|---|---|---|
| 2,760,795 | 8/1956 | Verson | 277/31 |
| 2,927,774 | 3/1960 | Ormsby | 277/31 |
| 3,400,938 | 9/1968 | Williams | 277/31 |

*Primary Examiner*—Robert I. Smith
*Attorney, Agent, or Firm*—Marcus L. Bates

[57] ABSTRACT

A heavy duty rotating blowout preventor which has a main outer support housing by which it can be affixed to the uppermost end of a casing, or to the uppermost end of a stack of tools affixed to the upper end of a casing. A rotating seal assembly includes a kelly drive bushing affixed to the uppermost end portion thereof, and a lower marginal end portion of the rotating seal assembly is removably received within the upper marginal end portion of the main support housing. The exposed upper marginal end portion of the rotating seal assembly forms an isolated bearing chamber by which the forces imposed by the kelly onto the rotating seal assembly is transferred into the main support housing in a new and novel manner. A stripper rubber assembly forms the lowermost end portion of the rotating seal assembly, and is separated from a nonrotating part of the rotating seal assembly by a stripper seal means which leads to a passageway underlying the bearing chamber. The passageway extends radially from the rotating part of the apparatus and conducts any leakage to ambient.

8 Claims, 7 Drawing Figures

HEAVY DUTY ROTATING BLOWOUT PREVENTOR

BACKGROUND OF THE INVENTION

The drilling of oil wells necessitates running thousands of feet of drill string down to a borehole forming bit, and the cuttings from the bit are removed by circulating drilling fluids down through the string to the bit and back up the borehole annulus to the surface of the earth. In order to prevent blowouts should a high pressure formation be encountered, and in order to continue drilling after penetrating such a high pressure formation, it is necessary to seal the top of the well casing respective to the drill string. Therefore, the rotating kelly which drives the drill string is sealingly engaged by a rotating blowout preventor which isolates the annulus formed between the borehole and the drill string from ambient.

It is customary to drive the rotating part of the rotating blowout preventor with a kelly drive bushing which is attached to the uppermost end of the rotating blowout preventor. A stripper rubber is usually affixed to the lower rotating part of the rotating blowout preventor and sealingly engages the kelly in a telescoping or slidable manner.

Accordingly, the rotating blowout preventor is continuously contacted by the mud; and therefore, the various bearings, seals, and other moving parts wear rapidly and will soon deteriorate in this harsh environment.

It would therefore be desirable to have made available a rugged rotating blowout preventor which has the bearings thereof sealed in such a manner that they avoid contact with foreign debris and accordingly enjoy a long life, so that the bearings and seals do not usually need replacement during the borehole forming operation.

SUMMARY OF THE INVENTION

This invention broadly encompasses an improved rotating blowout preventor having a rotating seal assembly removably mounted to a main support housing. The seal assembly includes a stripper rubber at the lower end thereof and a kelly drive bushing at the upper end thereof. The kelly or driving member is received through a longitudinally extending passageway formed axially through the entire apparatus. A lateral flow passageway is formed through a wall of the main housing and is placed in communication with the downhole side of the stripper rubber.

The rotating seal assembly includes a marginal upper end portion which extends well above the main housing and contains a bearing and seal chamber therein, thereby completely isolating the chamber from the high pressure side of the stripper rubber.

Another important feature of this invention lies in the provision of a series of radial ports leading to ambient and interposed between the bearing and seal chamber, and a lower stripper seal member which is interposed between the high pressure side of the stripper rubber and the radial ports. Should leakage occur from the high pressure side of the stripper rubber, across the lower seal, the flow will exhaust through the radial ports and into the atmosphere, thereby avoiding contamination of other critical rotating components of the present apparatus.

Still another important feature of the present invention is the provision of an improved kelly drive bushing which forms part of and drives the rotating seal assembly. The kelly drive bushing has a downwardly directed, cylindrical skirt member which sealingly engages a fixed outer skirt member of the rotating seal assembly and forms the uppermost end of the bearing and seal chamber.

Accordingly, a primary object of the present invention is the provision of a rotating blowout prevent which includes a rotating seal assembly removably affixed to a main support housing, with a bearing and seal chamber being located externally of the main support housing.

Another object of the present invention is the provision of an external bearing and seal chamber for a rotating blowout preventor which is permanently closed at the bottom end thereof and which contains seals at the upper end thereof, with bearings being contained therewithin.

A further object of this invention is the provision of a rotating seal assembly for a blowout preventor which has a kelly drive bushing together with a seal means which jointly form an upper closure member for a bearing chamber.

A still further object of this invention is to provide a rotating blowout preventor with a rotating seal assembly that includes a stripper rubber at the lower end thereof in underlying relationship to a seal and bearing chamber, with there being outflow ports interposed between the stripper rubber and the bearing chamber so that should the seal associated with the stripper rubber fail, debris will flow away from the rotating blowout preventor without contaminating the bearing chamber located thereabove.

A further object of the present invention is the provision of a rotating blowout preventor having a rotating seal assembly associated with a main support housing in such a manner that the bearings and seals therefor are isolated within an upwardly opening chamber, and furthermore, wherein there is arranged three different load bearing means which transfer the loads received from the rotating parts of the seal assembly into the main support housing in a new and novel manner.

A still further object of the present invention is the provision of a rotating blowout preventor having an upwardly opening cavity which forms a bearing chamber, and within which there is disposed a plurality of bearings arranged respective to one another and to the fixed and rotating parts of the rotating seal assembly in a novel manner so that loads imposed upon the rotating blowout preventor are transferred into the main support housing thereof and from which unexpected results accrue.

The above objects are attained in accordance with the present invention by the provision of a combination of elements which are fabricated in a manner substantially as described in the above abstract and summary.

These and various other objects and advantages of the invention will become readily apparent to those skilled in the art upon reading the following detailed description and claims and by referring to the accompanying drawings.

DETAILED DESCRIPTION OF THE PREFERRED EMBODIMENT

Throughout the various figures of the drawings, wherever it is practical or possible to do so, like numerals will refer to like objects or elements. The term "RBOP", wherever used in this specification and claims, is intended to mean a "rotating blowout preventor".

As seen disclosed in the various figures of the drawings, the apparatus of the present invention is a RBOP 10 which includes a rotating seal assembly 11 removably received within a main support housing 12 in such a manner that an upper marginal end portion 14 thereof extends freely uphole away therefrom with a clamp means 15 affixing the one to the other.

Figure 6:
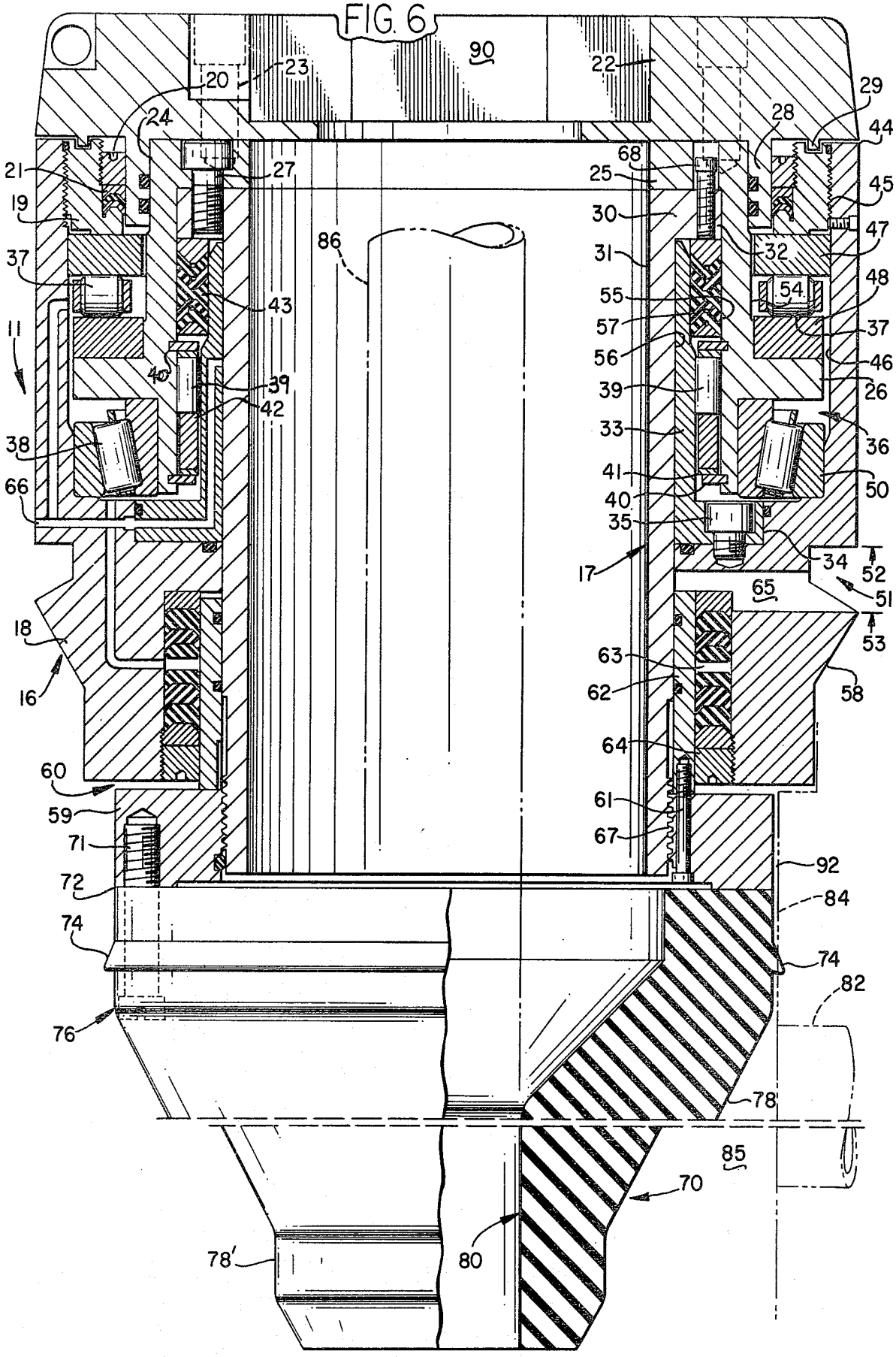
FIG. 6 is an enlarged, longitudinal, cross-sectional view of the apparatus disclosed in FIG. 5; and, FIG. 7 is a diagrammatical, part cross-sectional, part elevational representation of apparatus made in accordance with the present invention.

As more particularly illustrated throughout the various figures of the drawings, and specifically in FIG. 6, the rotating seal assembly of the present invention is comprised of a plurality of co-acting parts which include the illustrated fixed or non-rotating outer skirt member 16 within which there is rotatably received the rotating mechanism of the present invention 17.

The fixed member includes an outermost seat member 18 which is an integral part of skirt 16. The upper inner wall of the skirt threadedly engages nut 19. The inside upper end of the nut threadedly engages a top packing nut 20 which bears against a packing ring 21.

Kelly drive bushing 22 is bolted at 23 to an intermediate bearing support 24. The support includes an inturned load bearing flange 25 and an outturned load bearing flange 26, the details of which will be more thoroughly described later on. Bolt 27 attaches flange 25 to a flange 32 of a wash pipe 30. Skirt 28 and slinger ring 29 downwardly depends from and forms an integral part of the kelly drive bushing.

Flange 32 outwardly extends from the inside wall surface 31 of the wash pipe and into overlying relationship respective to a fixed inner housing 33. The inner housing terminates in a circumferentially extending flange 34 which is bolted at 35 to the before mentioned, fixed, outer skirt member, at a location where the seat member commences.

Bearing and seal chamber 36 is completely closed at the bottom and upwardly opens in an uphole direction. The chamber is formed between the inner housing and the outermost skirt member. Bearings 37, 38, and 39 are contained in the illustrated manner therewithin, with the upper bearing 37 being supported by the load transfer member 26, the lower bearing 38 bearing against the lower flange surface of the load transfer member, while the intermediate bearing 39 is located between the inner housing and the intermediate bearing housing. It will be noted that each of the three bearings has a portion thereof which bears against the intermediate bearing housing with at least one of the bearings transferring a lateral load against the wash pipe 30 by means of the inner housing, with the remaining bearings having a race thereof which bears directly against the outermost skirt member.

Upper and lower lock rings 40, 40', along with shim 41 and spacer 42, capture the intermediate bearing therebetween. Packing 43 is located between the bearing lock ring and flange 32.

Upper end 44 of the outermost skirt member has an inside marginal surface area thereof threaded at 45 for accommodating the nut 19 which in turn receives the packing nut 20. The inside wall surface 46 of the outermost skirt member bears against the upper race 47 of the upper bearing and is spaced from a lower race 48 thereof. Outer race 50 of the lower bearing is received against the inside wall surface 46 and a lower outer wall surface of the intermediate bearing housing.

Figure 1:
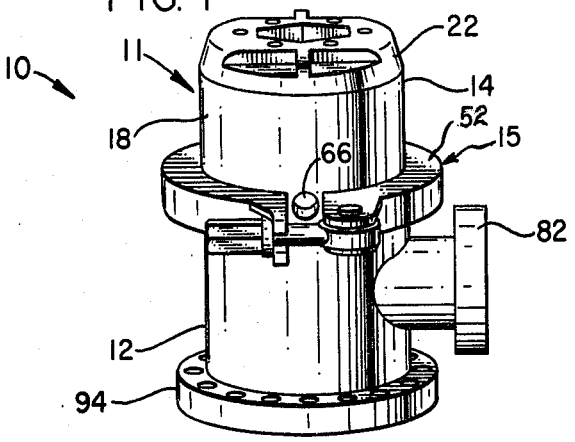
FIG. 1 is a perspective view which discloses a rotating blowout preventor made in accordance with the present invention.

Clamp groove 51 circumferentially extends less than 360° about the seat of the outermost skirt member, with the adjacent spaced ends of the groove terminating to leave a key way or projection which is received between the spaced, adjacent, pivotal end portions of the clamp for assuring nonrotation of the entire skirt member. The top surface 52 of the clamp is spaced from the top surface 53 of the main housing, as noted in FIGS. 1 and 7.

The outermost wall surface 54 of the rotatable, intermediate bearing housing is fixed with respect to the bearing race 48 and the downwardly depending skirt member 28. The inner wall surface 55 of the intermediate bearing housing is spaced from the outer wall surface 56 of the wash pipe with the inner fixed housing 33 and seal means 43 being received therebetween. Packing 43 is received within the seal chamber formed between the relative moving wall surfaces 57 and 55.

Conical surface area 58 is formed circumferentially about the seat of the outermost skirt member in spaced relationship to the bottom wash pipe nut 59, with there being a space 60 between the nut and the wash pipe. Bolt 61 attaches liner 62 to the nut and forms a replaceable, polished wear surface against which the lower or stripper packing 63 can wear, with the packing being interposed between the outermost skirt member and the wear sleeve. Packing nut 64 threadedly engages the lowermost, inside marginal wall surface of the seat of the outermost skirt member.

Radial ports 65 are located between the indicated elevations 52 and 53 and form a passageway which communicates the packing 63 with ambient. Grease passageway 66 leads to all of the bearings, seals, and co-acting slidable surfaces. The lower outside marginal end of the wash pipe is threaded at 67. Numeral 68 indicates an adjustable packing bolt.

A resilient stripper 70, preferably made of rubber, is affixed to nut 59 by means of bolt circle 71. Upper end 72 of the stripper includes a large diameter cylindrical portion thereof which includes the illustrated outturned flap 74 which circumferentially extends about the entire stripper and engages inner wall surface 84 of the main support housing. Bolt holes for receiving bolt 71 through the stripper rubber are indicated by numeral 76.

The stripper reduces in diameter at 78 and includes the usual inside diameter wall surface 80 through which the rotating driving member, such as a kelly, is received.

Figure 7:
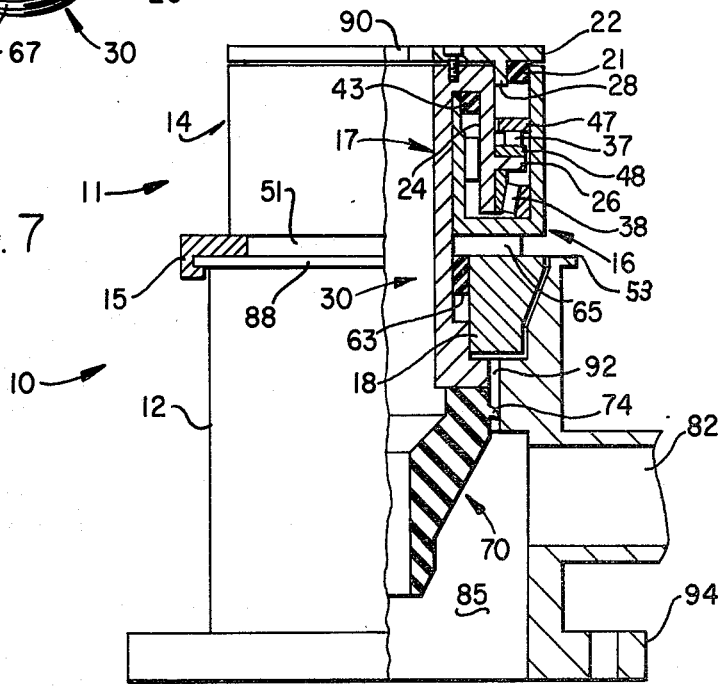

As seen in FIG. 7, together with other figures of the drawings, the present invention comprises a rotating blowout preventor 10 having a rotating seal assembly 11 which includes a lower marginal end portion thereof removably received within a main support housing 12. The seal assembly is affixed to the main support housing by a fastener means in the form of clamp 15.

The rotating seal assembly includes a stripper rubber 70 at the lower end thereof and a kelly drive bushing 22 at the upper end thereof. A driving member is received through the complementary central portion at 90 and extends through the longitudinal axial passageway where it sealingly engages the stripper in a slidable manner.

A stripper seal 63 separates the high pressure fluid at 85 from the passageway 65 and should leakage thereacross occur, fluid is conducted radially away from the RBOP in underlying relationship to a bearing and seal chamber 36.

The upwardly opening bearing chamber needs no seals at the lower end thereof; and therefore, fluid cannot gravitate in a downward direction therefrom. The bearing chamber is formed between members 18 and 33 and includes member 24 which subdivides the chamber into an inner annular chamber within which bearing 39 is housed and an outer annular chamber within which bearings 37 and 38 are housed. Flange member 26 is aligned with bearing 39 and bears against bearings 37 and 38 so that any outward pressure exerted by bearing 39 will not deform member 24 because of the presence of flange 26, and any inward pressure of bearing 39 is evenly distributed into the wash pipe and remaining structure by means of inner housing 33.

Seal 43 isolates the inner annular portion of chamber 36 while seal 21 isolates the outer annular portion thereof. Seal 21 cooperates with the circumferentially extending, downwardly directed, cylindrical skirt 28 formed integrally on the kelly drive bushing.

The provision of the spaced apart bearings in an isolated bearing chamber located externally of the RBOP and arranged in the novel manner set forth herein provides an unexpected durable apparatus which can withstand all of the forces involved in borehole forming operations.

The stripper seal 63 is interposed between the high pressure area 85 and ambient 65, and is associated with an outturned member 74 which tends to maintain annulus 92 free from debris so that no contaminant is forced into proximity of the stripper seal, thereby greatly adding to the life thereof.

Figure 2:
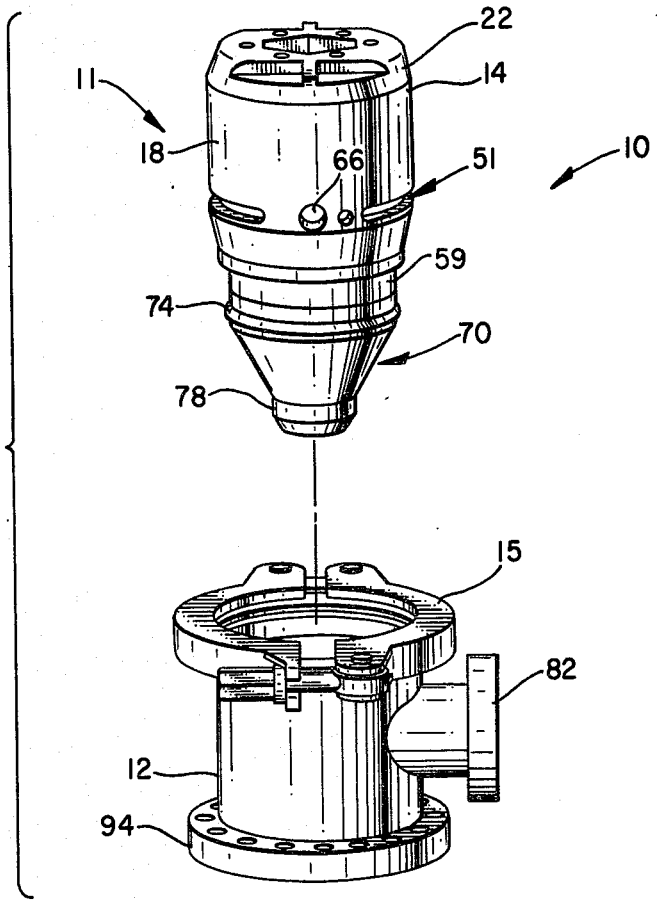
FIG. 2 is a partially disassembled view of the apparatus disclosed in FIG. 1.
Figure 3:
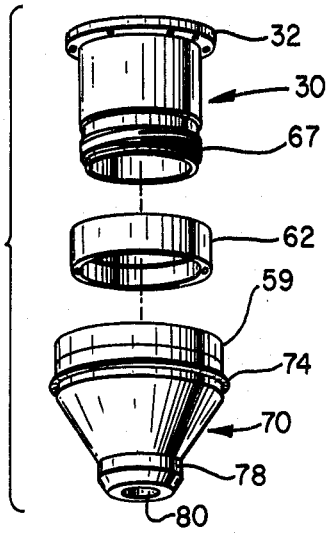
FIG. 3 is a partially disassembled view of part of the apparatus previously seen in FIG. 2.
Figure 5:
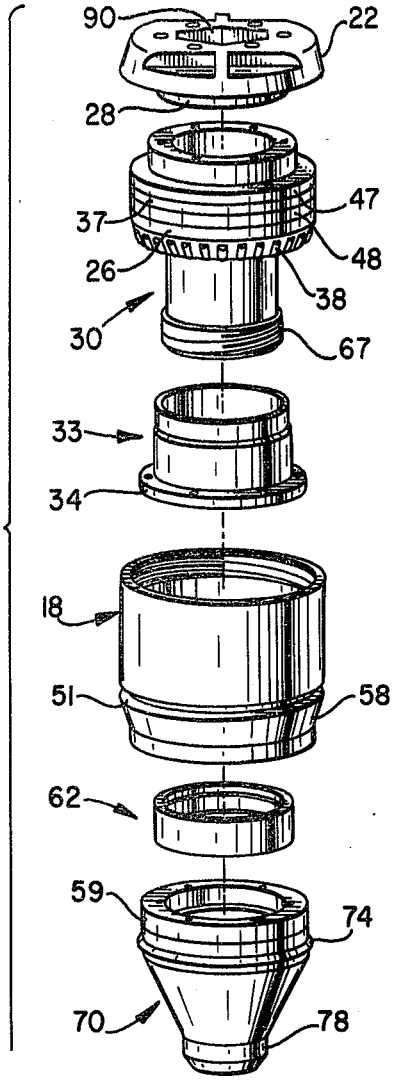
FIG. 5 is a perspective, exploded view of the apparatus disclosed in FIG. 1.
Figure 4:
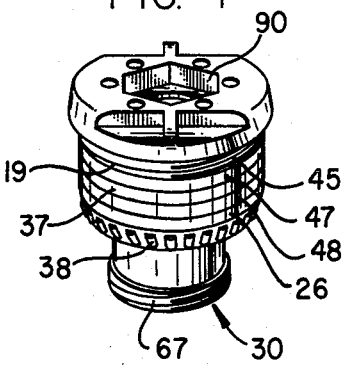
FIG. 4 is a perspective view of part of the apparatus disclosed in the foregoing figures, with some parts being removed therefrom so as to disclose the interior thereof.

From time to time the stripper rubbers must be replaced, and at other times it is advantageous to completely disassemble the apparatus for preventive maintenance. The apparatus is easily field repaired by removing clamp 15 and withdrawing the entire rotating seal assembly from the bowl-like main support member in the illustrated manner of FIG. 2. This expedient avoids the necessity of laboriously unbolting the flange 94 from the stack and lifting the entire RBOP onto the floor of the rig as is necessary with many prior art RBOPs.

After the rotating seal assembly has been removed from the bowl, the wash pipe, along with the bearings, can be removed from the outermost skirt member by unbolting the kelly drive bushing at 23 and thereafter removing the bolts 27, whereupon the intermediate bearing housing, along with the bearings affixed thereto, can be withdrawn from the wash pipe and the outermost skirt member.

Hence, it is evident that all of the components of the present apparatus can be easily and conveniently removed for inspection and repair with a minimum of down time and tools.

The illustrated unique arrangement of the three bearings within a common, upwardly opening chamber provides the added advantage of an RBOP which is unusually short or low in profile. This advantageously reduces the stack height and thereby provides additional space below the floor of the drilling rig, where height is always at a premium.

Further, to be able to change the sleeve of the RBOP without tearing down the entire assembly is a novel design feature. As previously noted, the bearing seals are not exposed to pressure, which avoids contamination thereof.

An adaptor is placed on the lower end at 92, which enables any desired stripper rubber to be incorporated into the present invention. Hence the stripper adaptor advantageously enables one to select and use any known stripper rubber which is compatible with the apparatus of the invention.

I claim:

1. A rotating blowout preventor having a main support housing (12) by which the rotating blowout preventor can be attached to the top of a stack of tools which are attached to a borehole casing; an axial passageway formed through said support housing;

a removable, rotating seal assembly (11), means forming a central, longitudinal passageway (30) through said seal assembly for receiving a rotating drive member (86) therethrough; means forming a lateral outlet flow passageway (82) in said support housing through which drilling mud can flow from said axial passageway;

said removable, rotating seal assembly having a lower marginal end portion thereof (18) adapted to be removably received within said axial passageway, means (15) affixing the lower marginal end of said seal assembly to the upper marginal end of said support housing;

said seal assembly includes a resilient stripper seal (70), a fixed outer skirt (16), and a rotatable inner skirt (31) concentrically arranged within said outer skirt; means (33, 46) forming a bearing and seal chamber (36) between said outer fixed skirt and said inner rotatable skirt; means (59) attaching said resilient stripper seal to the lower end of said inner skirt;

said bearing and seal chamber is closed at the bottom (51) and is upwardly opening with a seal means (43, 21) being located at the upper end thereof so that lubricant cannot gravitate therefrom should leakage occur across said seal means; means forming radially spaced outlet ports (65) located in underlying relationship respective to said bearing and seal chamber; an annulus (63) formed between said fixed and rotatable skirt members in underlying relationship respective to said outlet ports; lower seal means (63) located within said annulus with said lower seal means being located above said resilient stripper seal so that leakage of fluid across the stripper seal and the last said seal means is diverted through said radial ports rather than into said bearing chamber;

means forming first (54), second (50), and third (39) bearing means within said bearing and seal chamber, said first bearing means transfers an upward, vertical load from said rotatable inner skirt into said fixed outer skirt; said second bearing means transfers a downward and radially outward load from said rotatable inner skirt into said fixed outer skirt; and, said third bearing means transfers a radial load between said rotatable inner skirt and said fixed outer skirt.

2. The rotating blowout preventor of claim 1 wherein said removable, rotating seal assembly includes means forming a kelly drive bushing (22) at the upper end thereof by which a kelly can drive the rotating parts of the rotating seal assembly;

said bushing includes a downwardly depending skirt (28) spaced from said outer fixed skirt and is concentrically disposed within said bearing housing with an annulus (21) being formed therebetween, the first recited seal means (21) includes a seal which is positioned within said annulus for preventing flow therethrough and into said bearing and seal chamber.

3. The rotating blowout preventor of claim 1 wherein a sleeve (62) is removably affixed to the lower, outer marginal end of said rotatable skirt, the last said seal means (63) being positioned between said sleeve and said fixed outer skirt for preventing fluid flow from said stripper rubber towards said outlet ports and said bearing chamber.

4. The rotating blowout preventor of claim 1 wherein said removable, rotating seal assembly includes a kelly drive bushing at the upper end thereof by which a kelly can drive the rotating seal assembly;

said bushing includes a downwardly depending skirt spaced from said main outer housing and concentrically disposed within said bearing and seal chamber; said outer skirt being spaced from said downwardly depending skirt and forming an annulus therebetween, the first recited seal means being positioned within said annulus for preventing flow therethrough and into said bearing and seal chamber.

5. The rotating blowout preventor of claim 1 wherein said rotatable skirt (31) includes an intermediate bearing support (24) affixed thereto, said bearing support having an outturned load bearing flange (26) which supports the uppermost of said bearings (54) and subdivides said bearing chamber into inner and outer concentrically arranged bearing-containing annular chambers, a lowermost of said bearings (50) bears against said bearing support and said fixed skirt, another of said bearings (39) being located intermediate of said upper and lower bearings at a location between said rotatable skirt and said bearing support.

6. A rotating blowout preventor having a main support housing and means by which said housing can be connected to the top of a stack in underlying relationship to the floor of a drilling rig; means forming an outlet in said main housing through which fluid can flow from said stack;

a rotating seal assembly having a fixed outer skirt; means removably mounting a lower marginal end of said seal assembly within the upper marginal end of said main housing, a stripper rubber connected to the lower end of said seal assembly for receiving a driving member therethrough, said stripper rubber is positioned respective to said outlet such that flow can occur up the annulus formed between a driving member and the main housing and through said outlet;

a rotatable inner sleeve, a kelly drive bushing affixed to the upper end of said rotatable sleeve, a stripper rubber adaptor affixed to the lower end of said rotatable sleeve for receiving said stripper rubber thereon such that a driving member can engage said kelly drive bushing and turn said inner sleeve relative to said fixed outer skirt;

an upwardly opening bearing and seal chamber formed between said rotatable inner sleeve and said fixed outer skirt, said chamber being closed at the bottom and including bearing means located therewithin which are mounted to transfer vertical and lateral loads between said inner sleeve and said outer skirt; seal means closing the opening in the upper end of said chamber;

a lower seal means formed between said outer skirt and said inner sleeve; said chamber is located above and spaced from said rubber stripper by said lower seal means; flow passageway means formed radially outward from said lower seal means and below said bearing housing, so that should leakage of drilling fluid flow across said lower seal means occur, the fluid is diverted through said passageway and cannot flow into said bearing chamber and contaminate the bearings.

7. The rotating blowout preventor of claim 6 wherein said rotating seal assembly includes a kelly drive bushing at the upper end thereof by which a kelly can drive the rotatable inner sleeve of the seal assembly;

said bushing includes a downwardly depending skirt member spaced from said fixed outer skirt and concentrically disposed within said bearing housing; said outer skirt and said downwardly depending skirt member having an annulus formed therebetween, an upper seal means positioned within said annulus for preventing flow therethrough and into said bearing and seal chamber.

8. The rotating blowout preventor of claim 6 wherein said rotatable skirt includes an intermediate bearing support affixed thereto, said bearing means includes a plurality of spaced bearings; said bearing support includes an out-turned load-bearing flange which supports the uppermost of said bearing means and subdivides said bearing chamber into inner and outer bearing-containing annular chambers, a lowermost of said bearing means bears against said bearing support and said fixed skirt, and other of said bearing means being located intermediate of said upper and lower bearings at a location between said rotatable skirt and said bearing support.

* * * * *